US011839573B2

(12) United States Patent
Shekhman

(10) Patent No.: US 11,839,573 B2
(45) Date of Patent: Dec. 12, 2023

(54) SURGICAL POSITIONER

(71) Applicant: ForTruss, LLC, Farmington, CT (US)

(72) Inventor: Mark Shekhman, Farmington, CT (US)

(73) Assignee: ForTruss, LLC, Farmington, CT (US)

( * ) Notice: Subject to any disclaimer, the term of this patent is extended or adjusted under 35 U.S.C. 154(b) by 204 days.

(21) Appl. No.: 17/532,134

(22) Filed: Nov. 22, 2021

(65) Prior Publication Data

US 2022/0079825 A1 Mar. 17, 2022

Related U.S. Application Data

(62) Division of application No. 15/930,950, filed on May 13, 2020, now Pat. No. 11,197,795.

(60) Provisional application No. 62/934,860, filed on Nov. 13, 2019, provisional application No. 62/847,054, filed on May 13, 2019.

(51) Int. Cl.
*A61G 13/00* (2006.01)
*A61G 13/12* (2006.01)

(52) U.S. Cl.
CPC ..... *A61G 13/0081* (2016.11); *A61G 13/1245* (2013.01); *A61G 2200/327* (2013.01)

(58) Field of Classification Search
CPC ..... A61G 13/0081; A61G 13/1245; A61G 2200/327; A61F 5/01
See application file for complete search history.

(56) References Cited

U.S. PATENT DOCUMENTS

| | | | | |
|---|---|---|---|---|
| 3,813,091 | A | 5/1974 | Metzger | |
| 5,001,739 | A | 3/1991 | Fischer | |
| 5,289,603 | A | 3/1994 | Kumagai | |
| 5,742,963 | A | 4/1998 | Trevino et al. | |
| 2004/0102792 | A1 | 5/2004 | Sarin et al. | |
| 2004/0133979 | A1 | 7/2004 | Newkirk et al. | |
| 2009/0198276 | A1 | 8/2009 | Lee | |
| 2012/0186020 | A1 | 7/2012 | Malakhov | |
| 2013/0192609 | A1 | 8/2013 | Bellows et al. | |
| 2013/0312189 | A1 | 11/2013 | Sarma et al. | |
| 2014/0190488 | A1 | 7/2014 | Robran et al. | |
| 2015/0297435 | A1 | 10/2015 | Visco | |
| 2017/0216122 | A1* | 8/2017 | White | A61B 6/0407 |
| 2018/0140493 | A1* | 5/2018 | Shandas | A61G 13/08 |
| 2019/0247214 | A1 | 8/2019 | Siers et al. | |
| 2020/0360213 | A1 | 11/2020 | Shekhman | |

FOREIGN PATENT DOCUMENTS

WO 2020232097 A1 11/2020

* cited by examiner

*Primary Examiner* — Justin C Mikowski
*Assistant Examiner* — Adam C Ortiz
(74) *Attorney, Agent, or Firm* — MINTZ LEVIN COHN FERRIS GLOVSKY AND POPEO, PC

(57) ABSTRACT

In general, various surgical patient positioners and methods for using the same are provided. For example, a surgical patient support is provided for use during anterior hip replacement surgery. The surgical patient support can have a body support configured to receive an upper body of a patient thereon and one or more extremity supports configured to receive one or more patient extremities thereon.

4 Claims, 7 Drawing Sheets

SURGICAL POSITIONER

CROSS-REFERENCE TO RELATED APPLICATIONS

This present application is a divisional of U.S. patent application Ser. No. 15/930,950 filed on May 13, 2020 and entitled, "Surgical Positioner," which claims the benefit of U.S. Provisional Patent Application No: 62/847,054, filed May 13, 2019 and entitled "Surgical Positioner," and 62/934,860, filed Nov. 13, 2019 and entitled "Surgical Positioner," the entireties of which are hereby incorporated herein by reference.

FIELD

Surgical patient positioners are provided for supporting and maintaining a position of a patient during hip replacement surgery.

BACKGROUND

During many surgical operations, correctly positioning a patient is important to allow access to relevant surgical sites on the patient and to help the surgeon complete the operation in an efficient and safe manner. For example, when using an anterior approach to perform a hip replacement, the patient must be properly positioned to allow the surgeon adequate access to the patient's relevant anatomy in order to properly position the hip replacement implants.

However, proper positioning or orientation of the patient requires various medical staff to physically position a patient on an operating room table prior to surgery and potentially hold or reposition a patient during the operation. As such, the medical staff may be required to physically be able to maneuver the patient, must have experience and training to know what orientations are preferred, and may be unable to help during the operation because they are required to reposition or maintain a position of the patient. These requirements create a steep learning curve for anyone assisting in relevant operations, and there is often a large amount of inconsistency in the ability of medical staff to properly and reproducibly position a patient. While attempts have been made to design various traction tables to standardize positioning of patients, the tables are expensive, difficult to use, and can be large and bulky enough to interfere with medical staff during operations.

Accordingly, a simpler and more reliable way to position patients during surgery is needed.

SUMMARY

In general, various surgical positioners and methods for using the same are provided.

In one aspect, a patient positioner is provided for maintaining a position of a patient on an operating surface during anterior hip replacement surgery that includes a body support and one or more extremity supports. The generally rectangular body support has a lower surface configured to rest against the operating surface and an upper surface that has a recess formed therein with a shape configured to receive an upper body of the patient therein. The one or more extremity supports are configured to engage the body support. Each extremity support has a lower surface configured to rest against the operating surface or the body support and an upper surface configured to receive and support an extremity of the patient thereon. Additionally, each extremity support is configured to couple to the body support in a first predetermined position to receive and support a left extremity of the patient and a second predetermined position to receive and support a right extremity of the patient.

The positioner can have numerous variations. For example, at least one of the extremity supports can be configured to removably engage the body support at a distal end of the body support, and it can be positioned to receive a hip of the patient thereon. In another example, at least one of the extremity supports can be a lower extremity support configured to removably engage the body support at a distal end of the body support and configured to receive at least one leg of the patient thereon. The lower extremity support can be configured to removably receive a plurality of posts thereon, and the plurality of posts can be configured to control positioning of the at least one leg of the patient. In other examples, at least one of the extremity supports can be configured to engage a recess formed in the body support. At least one of the extremity supports can also be configured to align with at least another one of the extremity supports to together define a channel, groove, or recess therein for seating a patient's extremity, such as a hip and/or leg. In another example, the one or more extremity supports can include at least one hip support and at least one leg support. In some examples, the body support and the one or more extremity supports can be configured to be included in a single kit.

In another embodiment, a patient positioner is provided for maintaining a position of a patient on an operating surface. The patient positioner includes a body support that has a proximal end, a distal end, and two indentations formed on top and bottom surfaces of the body support. The top and bottom surfaces of the body support are mirror images of each other, and the body support is angled or sloped upward from the proximal end to the distal end.

The positioner can vary in numerous ways. For example, the body support can have an operative side and a non-operative side, and the body support can be angled higher on the operative side than the non-operative side. In another example, a hip recess can be formed on the operative side of the body support. In some examples, the body support can have a cover layer, a middle layer, and a rigid plastic layer.

In another aspect, a method is provided of positioning a patient for an anterior hip replacement surgery. The method includes arranging the patient on a surgical patient positioner such that an upper body of the patient is positioned on a body support of the surgical patient positioner, an operative leg of the patient is positioned on a first hip support and a lower extremity support of the surgical patient positioner, and a non-operative leg of the patient is positioned on a second hip support and the leg support of the surgical patient positioner. The method also includes removing the first hip support to access an acetabulum of the operative leg of the patient. The method further includes lowering the lower extremity support to access a femur of the operative leg of the patient.

The method can have numerous variations. For example, the method can include abducting the non-operative leg of the patient such that the lower extremity support maintains abduction of the non-operative leg while accessing the femur of the operative leg. In another example, the method can include rearranging the first and second hip supports and the lower extremity support such that the non-operative leg is positioned on the first hip support and the lower extremity support and the operative leg is positioned on the second hip support and the lower extremity support. The method can also include removing the first hip support to access an acetabulum of the non-operative leg of the patient, and lowering the lower extremity support to access a femur of the non-operative leg of the patient.

The details of one or more variations of the subject matter described herein are set forth in the accompanying drawings and the descriptions below. Other features and advantages of the subject matter described herein will be apparent from the descriptions and drawings, and from the claims.

DESCRIPTION OF DRAWINGS

This invention will be more fully understood from the following detailed description taken in conjunction with the accompanying drawings, in which.

DETAILED DESCRIPTION

Figure 1:
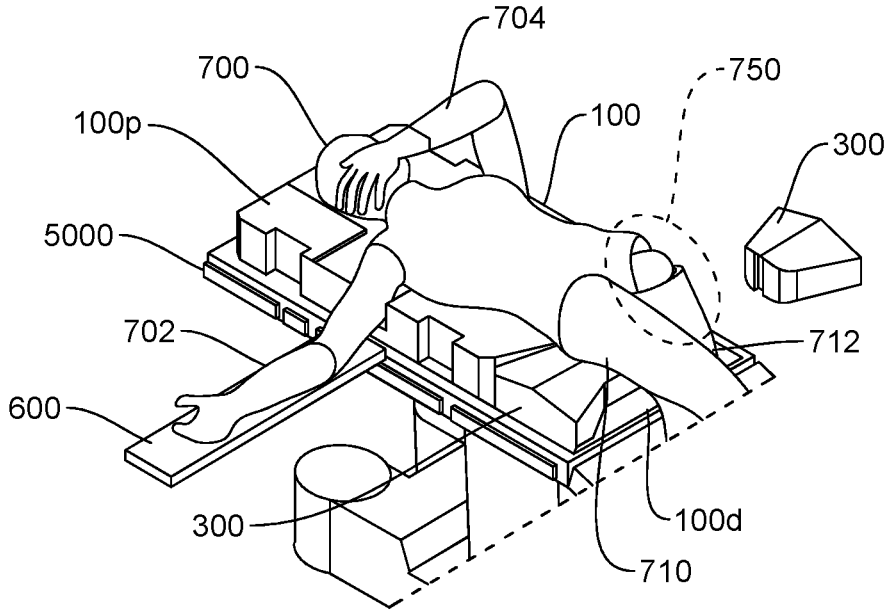
FIG. 1 is a perspective view of an upper half of a patient arranged on one embodiment of a surgical positioner on top of an operating room table.

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Further, in the present disclosure, like-named components of the embodiments generally have similar features, and thus within a particular embodiment each feature of each like-named component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Sizes and shapes of the systems and devices, and the components thereof, can depend at least on the anatomy of the subject in which the systems and devices will be used, the size and shape of components with which the systems and devices will be used, and the methods and procedures in which the systems and devices will be used. Like reference symbols in the various drawings indicate like elements.

Surgical patient positioners and stabilizers are provided that can be used during surgery to support, position, and stabilize a patient to help reduce or eliminate involuntary or unexpected movements during surgery. A patient can be positioned on the surgical positioner in preparation for surgery to ensure that the patient is in an ideal orientation during the operation. For example, the positioner can maintain the patient's arms, legs, and/or torso at desired angles and in desired alignments. As such, a surgeon can have greater access to specific surgical site(s) of interest on the patient's body based on the operation to be performed. Additionally, the surgical positioner can have one or more portions that are removable and/or rearrangeable to allow for flexibility in positioning the patient both before and during an operation. This preferred positioning allows surgeons and medical staff to focus on the operation without having to continually hold or reposition the patient's body in desired orientations. The surgeon thus has a more stable surgical site on which to operate, and surgical staff can focus on the needs and flow of the operation, such as anticipating needs of the surgeon and/or required tools. For users who may not be strong enough or experienced enough to properly position a patient during surgery, especially during an extended operation, the surgical positioner also serves as a support and guide to correctly orient the patient and to correctly maintain the patient in the preferred position without requiring continuous physical exertion by a user. As such, particular body positions of patients are more consistent across multiple surgeries thus reducing variability within and across operations, allowing specific orientations to be continually used by multiple surgeons, patients, medical staff, etc. unrelated to individual experience and training of the staff. The surgical positioners provided herein are particularly useful during an anterior hip replacement surgery to reduce the risk of damage to patient tissue, allow for smaller incision sites, and to aid in patient recovery. However, surgical positioners can be used for other surgeries depending on desired orientations of the patient, accessibility to select surgical site(s), etc., such as within a scope of Orthopaedic surgery and/or among other surgical specialties. The surgical positioners can also be used with any standard operating table, thus avoiding the need for costly customized tables. For example, the patient positioners and stabilizers provided herein can be reusable across multiple operations.

In one exemplary embodiment, a surgical patient positioner is provided having a body support with one or more surgical hip supports, a lower extremity support, and padded posts to hold the lower extremities in desired configurations. The body support can be configured to receive and support an upper body of a patient thereon, such as a patient's head, torso, buttocks, etc. The lower extremity support can receive and support one or more patient extremities thereon, such as the patient's legs. The one or more surgical hip supports, the lower extremity support, and the padded posts can mate with the body support in a number of arrangements to function together to maintain the upper body and the lower extremities of the patient in a pre-selected position. Before and/or during use, the surgical hip supports, the lower extremity support, and/or the padded posts can be rearranged to position the patient in one or more different pre-selected positions. As such, the surgical patient positioner can allow users to orient the patient in various pre-selected desired positions for each operation being performed. One or more of the surgical hip supports and/or padded posts can also be rearranged and/or removed entirely during use to allow users to access particular surgical sites, while the body support, the lower extremity support, and any other surgical hip supports and/or padded posts continue to maintain the patient in a desired position.

FIGS. 1-13 illustrate one exemplary embodiment of a surgical positioner that has a body support 100, hip supports 300, a lower extremity support 400, and padded posts 450. The body support 100 can include a bottom or lower surface configured to be placed on a surface of an operating environment, such as an operating room table 5000, and a top or upper surface having a recess that is contoured to receive an upper body of a patient to support and maintain the upper body in a stable, preselected position. As illustrated in FIGS. 3-6, the body support 100 has proximal and distal ends 100*p*, 100*d* with a head indentation 110, shoulder/arm channels 112, 114, a torso indentation 116, and buttocks and lower body indentations 118. As such, the patient can be arranged on his or her back on the support 100. However, in other embodiments, the body support 100 can be contoured to receive different body features of the patient and/or can receive body features of the patient in different orientations depending on the operation to be performed. Additionally, the shoulder/arm channels 112, 114 can have additional arm support thereon, such as boards protruding therefrom, cushioning material therearound, additional material, etc. to provide additional support to either of the patient's arms as needed.

The body support 100 can generally have a rectangular shape with four sidewalls, two shorter sidewalls at proximal and distal ends 100*p*, 100*d* and two longer sidewalls 102, 104, for example on a surgical side and a non-surgical side. However other shapes are possible, such as oval, etc., depending on the operation to be performed and the expected patient body types, population, etc. The positioner can have a variety of dimensions depending on the operation to be performed, the expected patient size and/or population, etc.

Figure 3:
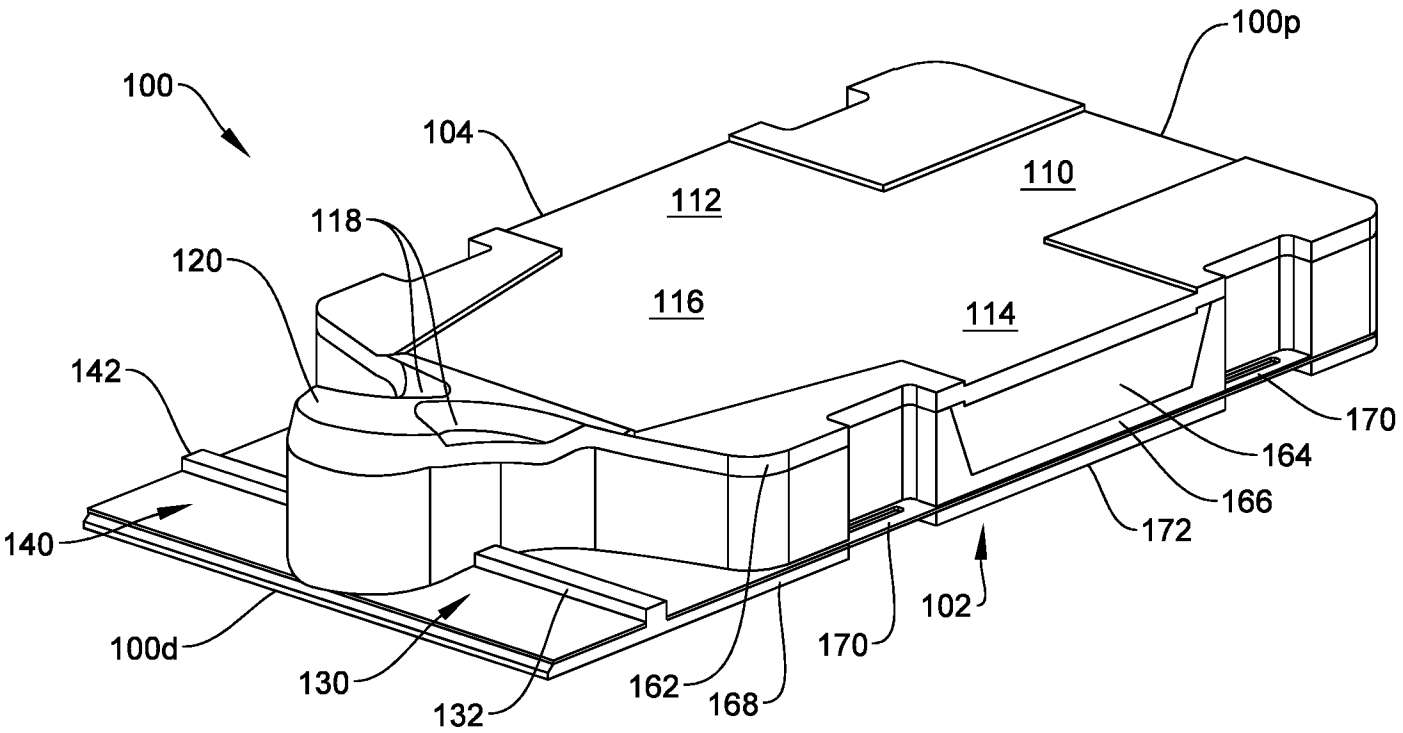
FIG. 3 is a perspective view of a body support of the surgical positioner of FIG. 1.
Figure 5:
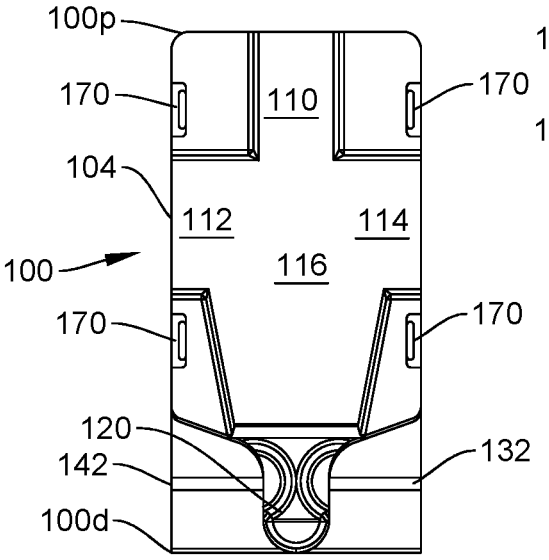
FIG. 5 is a top-down view of the body support of the surgical positioner of FIG. 1.
Figure 6:
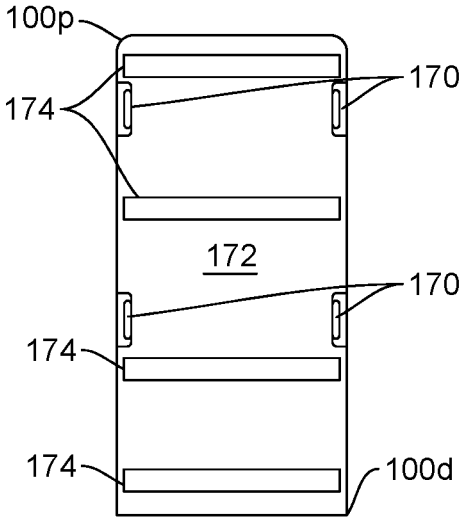
FIG. 6 is a bottom-up view of the body support of the surgical positioner of FIG. 1.

The illustrated buttocks indentations 118 is contoured to tilt a pelvis of the patient upward to provide better access to a surgically-relevant or operative hip of the patient, for example during an anterior hip replacement surgery. As shown in FIGS. 3 and 5, the indentation 118 additionally terminates in a protruding groin post 120 on the distal end 100*d* of the body support 100 that prevents or resists patient movement during use. For example, the groin post 120 can resist sliding of the upper body of the patient when traction is applied to the patient during an operation.

Figure 4:
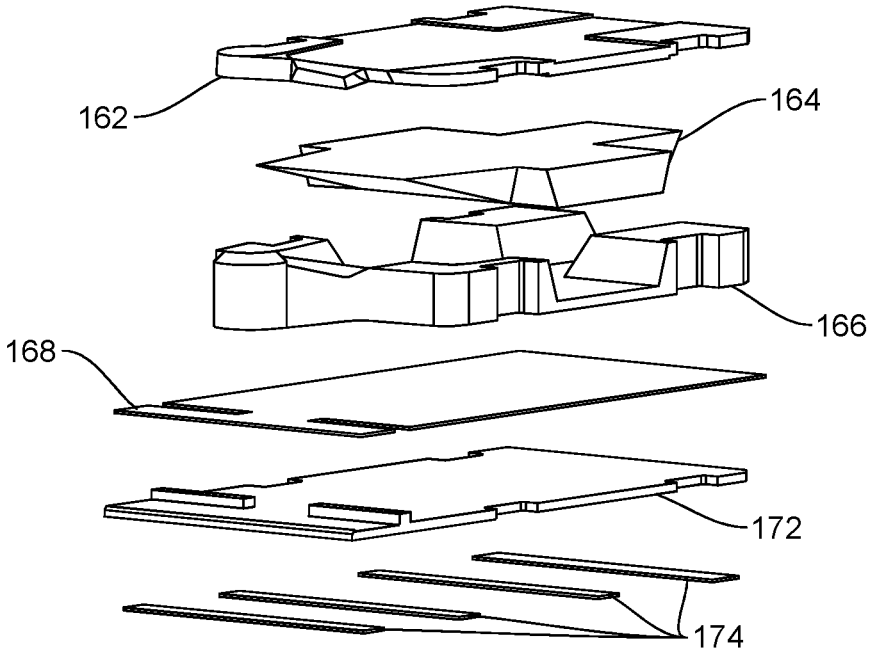
FIG. 4 is an exploded perspective view of the body support of the surgical positioner of FIG. 1.

As illustrated in FIG. 4, the body support 100 can also include a plurality of layers arranged together to provide variations in contouring and material properties, for example allowing different positioning and different material properties depending on an operation to be performed. For instance, the body support 100 can have one or more layers of foam material to provide varying contours and firmness during use, a rigid layer to provide additional strength to the foam layers and help support the patient thereon, and one or more various means for attaching the support 100 to an operating room surface. The illustrated embodiment has a top layer 162 of memory foam material, a middle layer 164 of memory foam material, a firm foam body recess layer 166, a rigid plastic layer 168 with table strap slots 170, a firm foam base layer 172, and one or more Velcro strips 174 to secure the support 100 to a surface. However, the support 100 can be secured to an operating surface through a variety of means, such as adhesion, hook and loop fasteners, straps, tape, friction, etc. The foam layers are also contoured around the table strap slots 170 to allow easier access thereto. As noted, one or more foam layers and one or more rigid layers can be used in other embodiments to vary the firmness, positioning, support, etc. for different types of operations. Additionally, layers in the illustrated surgical positioner are fixed in place. However, in other embodiments, various layers can be removable and/or replaceable to allow customization of the surgical positioner for each operation being performed.

A first cavity 130 is formed on a corner of the illustrated body support 100 between the distal end 100*d* and the side 102 of the support 100, and a second cavity 140 can be formed opposite the first cavity 130 on a corner of the body support 100 between the distal end 100*d* and the side 104 of the support 100, as illustrated in FIG. 3. The first and second cavities 130, 140 can each be contoured to removably receive an extremity support, such as a surgical hip support 300 therein, as discussed below. Guide ridges 132, 142 protrude upward from the bottom layers of the body support 100 into each cavity 130, 104. The guide ridges 132, 142 correspond to a groove 306 formed in the surgical hip support 300 and help to guide the surgical hip support 300 into place and maintain a position of the surgical hip support 300 during use. In the illustrated embodiment, each cavity 130, 140 is in the form of a generally oblong triangular recess with a substantially planar bottom surface and a curved sidewall, but other shapes and configurations are possible. Additionally, the illustrated guide ridges 132, 142 extend from the firm foam base layer 172 through slots formed in the rigid plastic layer 168. However, other guiding and securing arrangements are possible, such as ridges on the rigid plastic layer, Velcro straps, friction force, etc.

Figure 7:
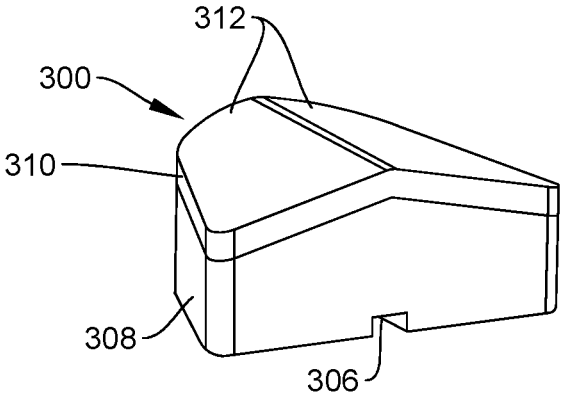
FIG. 7 is a perspective view of a hip support of the surgical positioner of FIG. 1.
Figure 8:
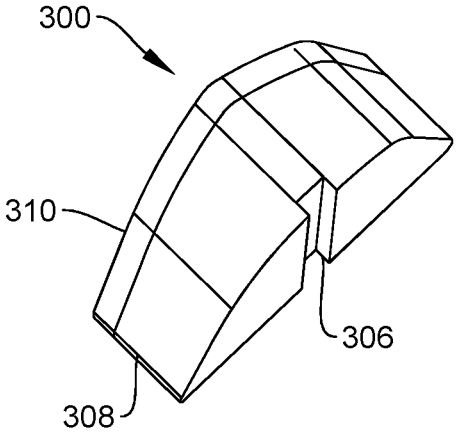
FIG. 8 is a perspective view of the hip support of the surgical positioner of FIG. 1.
Figure 9:
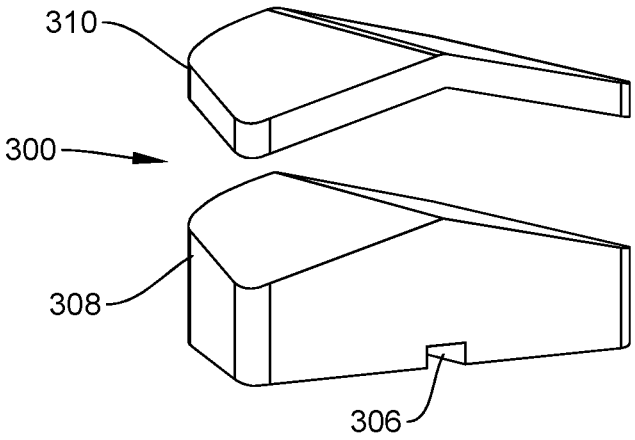
FIG. 9 is an exploded perspective view of the hip support of the surgical positioner of FIG. 1.

The hip support 300 illustrated in FIGS. 7-9 can support a hip of the patient, such as a hip to be operated on, during positioning of the patient. The support 300 is received in one or both of the cavities 130, 140. The illustrated hip support 300 has a lower base layer 308, an upper layer 310 on which the surgically-relevant hip can rest during positioning, and a partial buttocks indentation or angulation 312 formed thereon that aligns with the buttocks indentation 118 of the body support 100. The illustrated base layer 308 is a firm foam base layer while the upper layer 310 is a top soft memory foam layer. However, in other embodiments, the hip support 300 can be one or more layers, and the materials used can vary to provide desired levels of firmness, support, etc. for each operation. Additionally, as noted above, a groove 306 is formed in a bottom surface of the support 300 that corresponds to the guide ridges 132, 142 so that, when the support 300 is placed into one of the cavities 130, 140, the corresponding guide ridge 132, 142 is receivable in the groove 306 to help guide the support 300 into place and secure the support 300 during use. The support 300 is generally triangularly oblong with two sidewalls, a planar sidewall and a curved sidewall. The illustrated surgical hip support 300 has an outer sidewall that is sized and shaped to sit flush with the sides 102, 104 of the body support 100, and the inner sidewall of the hip support 300 has a shape that matches a shape of the curved sidewall of the cavity 130, 140. However, in other embodiments, the surgical hip support 300 can have different sizes and shapes depending on a surgical site to be accessed.

The surgical hip support 300 is also removable from the surgical positioner 100 during use. For instance, hip supports 300 can be inserted into the cavities 130, 140 during positioning of a patient. One of the hip supports 300 can then be removed during operation, such as on the surgical or operative side of the patient, so that a surgeon can more easily access a relevant surgical site on the surgically-relevant hip while the body support 100 and the other extremity supports continue to support the patient. For example, a surgeon can more easily access the patient's acetabulum in the surgically-relevant leg during an anterior hip replacement surgery by removing a first support 300 entirely during use, while another support 300 and/or the lower extremity support 400, discussed below, continue to support the patient's legs.

Figure 10:
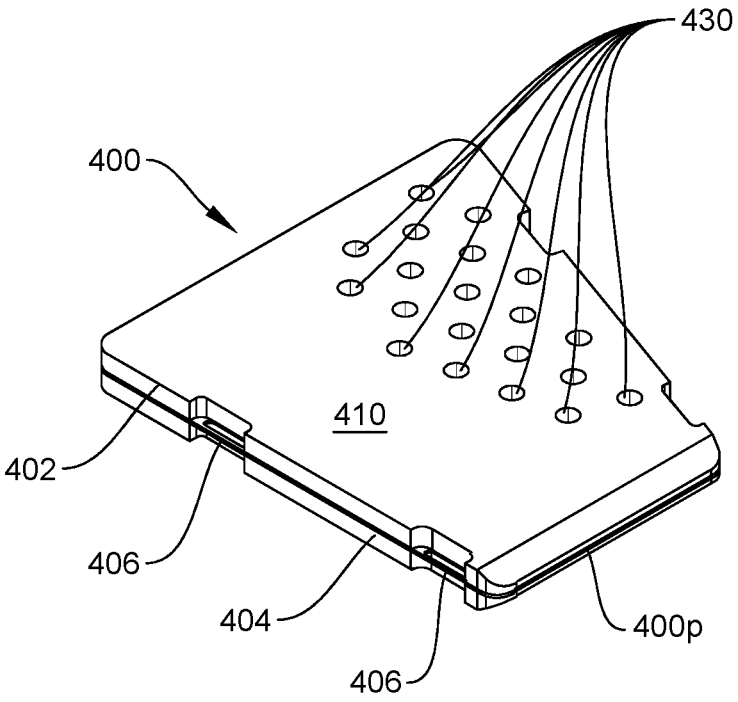
FIG. 10 is a perspective view of a lower extremity support of the surgical positioner of FIG. 1.
Figure 11:
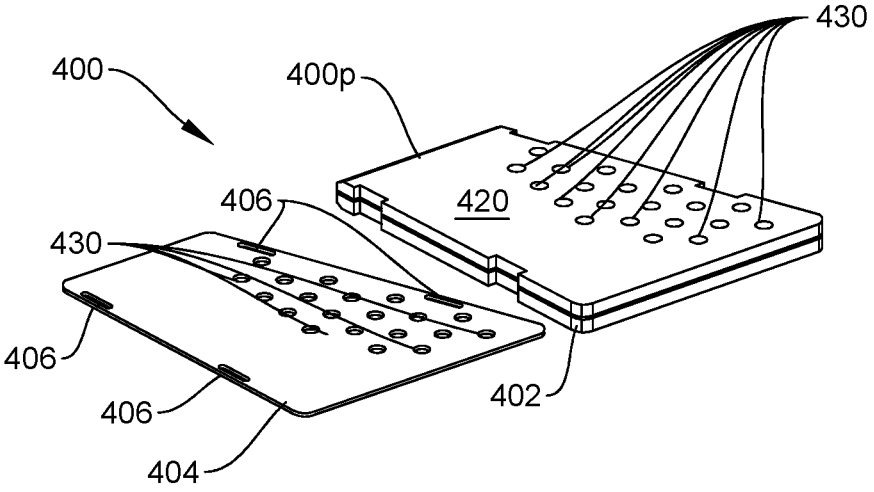
FIG. 11 is an exploded perspective view of the lower extremity support of the surgical positioner of FIG. 1.

The lower extremity support 400 supports the patients legs during surgery, and the support 400 and one or more padded posts 450 function together to help position a surgically-relevant leg of the patient and maintain the position during an operation. The leg support 400 has a tapered proximal end 400*p* that, in use, extends distally from the distal end 100*d* of the body support 100. As illustrated in FIGS. 10 and 11, the illustrated leg support 400 has a flat upper surface 410 on which the patient's legs can rest, a flat lower surface 420, and one or more openings or holes 430 extending therebetween that each receive a portion of a padded post 450, discussed below. The openings 450 are arranged at pre-selected positions to allow the posts 450 to hold the operative and/or non-operative leg in a desired position with a desired amount of hip external rotation, distraction, hip adduction, and hip abduction. While 20 openings 430 are illustrated, one or more openings can be provided in different embodiments. The support 400 can also be flipped longitudinally 180 degrees to accommodate different surgically-relevant legs, for example left and right direct anterior hip replacement. A surgeon can thus rearrange the support 400 to operate on a contralateral limb of the patient.

The support 400 has a generally trapezoidal shape, and each side of the support 400 can optionally be used to support one or both of the patient's legs. As such, an additional positioner, such as an arm board, may not be required to be attached to the support 400, thus simplifying the arrangement. The illustrated support 400 is also formed of two components, a firm foam covering 402 that represent top and bottom layers, and an insertable rigid plastic middle layer 404. The rigid plastic middle layer 404 has openings 406 for table straps therein, and the covering 402 can have cut-out sections to allow access to the openings 406. The entire support 400 can consequently be secured to an operating table via straps. Furthermore, the lower extremity support 400 can be lowered during use relative to the body support 100. For example, the support 400 can be attached to a movable leg platform in an operating environment and lowered with the leg platform to allow for femoral preparation in the surgically-relevant leg positioned on the support 400 in an anterior hip replacement surgery. The proximal end 400*p* of the support 400 can thus meet the distal end 100*d* of the support 100 over the table break.

Figure 2:
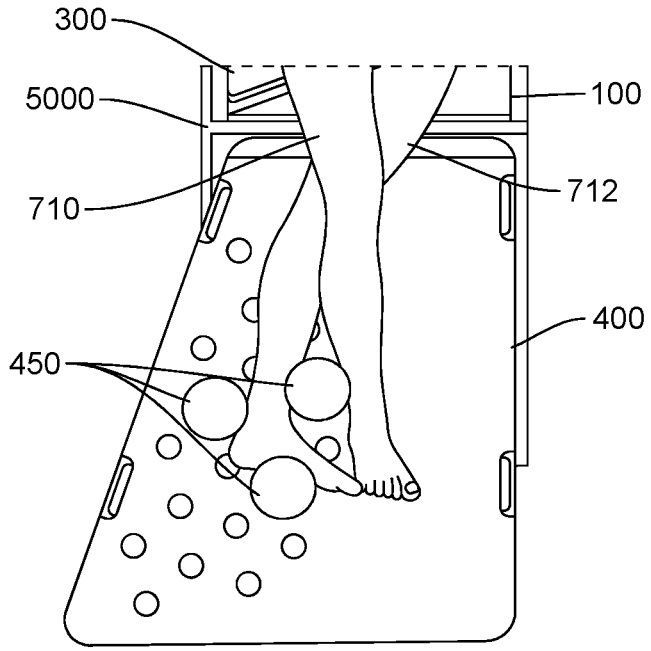
FIG. 2 is a perspective view of a lower half of a patient arranged on the surgical positioner and the table of FIG. 1.
Figure 12:
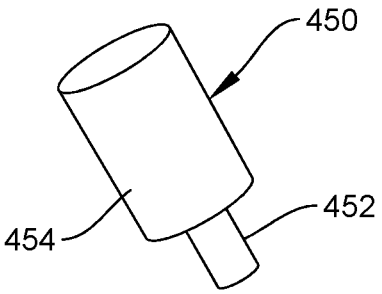
FIG. 12 is a perspective view of a padded post of the surgical positioner of FIG. 1.

As illustrated in FIG. 12, each padded post 450 has a shaft base 452 and a padded covering 454 that covers a distal end of the shaft base 452 and extends partially along the shaft base 452. A proximal end of the shaft base 452 is receivable in one of the openings 430 so that the padded covering 454 of the post 450 extends vertically upward from the upper surface 410 of the support 400. As illustrated in FIG. 2, one or more posts 450 can thus be positioned to secure one or both of the patient's legs in an optimal position during an operation, for example by placing posts 450 on multiple sides of the patient's leg, and the positioning can be readjusted during use if needed. The level of hip rotation can be controlled by post 450 position by securing the patient's foot, for example as illustrated in FIG. 2, via foam compression. When using a sterile drape, the posts 450 can be prominent enough to be felt through the drape to assist the surgeon. One or more padded posts 450 can be provided with each support 400, for example three, four, or five posts.

The support 400 and the posts 450 can thus allow a surgically-relevant leg to be adducted, and the body support 100, the hip supports 300, the lower extremity support 400, and the posts 450 can be engaged together in different combinations depending on which side of the patient is surgically relevant and/or can be rearranged during an operation to allow access to both sides. The body support 100 and the lower extremity support 400 can also optionally be used individually. The specific orientation and positioning of the patient with each combination can also be maintained between the body support 100, the hip support 300, the lower extremity support 400, and the posts 450 across multiple uses with different surgeons, different patients, different operating environments, etc. to provide consistent patient positioning.

Figure 13:
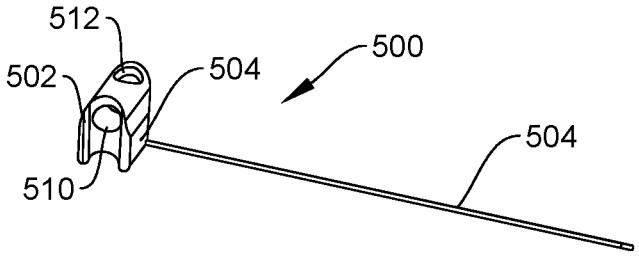
FIG. 13 is a perspective view of an arm support of the surgical positioner of FIG. 1.

As illustrated in FIG. 13, one or more arm supports 500 can also be used with the body support 100 to secure the patient's arm in position. The support 500 has an arm support base 502 and a strap 504 to secure the support 500 in place. The base 502 has a slot 508 into which the strap 504 can extend, a lumen 510 extending through the base 502 that is configured to receive the patient's upper extremity, such as the patient's arm and/or hand, and an opening 512 in the base 502 to assist in positioning the patient's extremity. Use of the arm supports 500 is optional, however, and the support 500 can be excluded.

Kits with various components can be provided to users, for example including one body support 100, two hip supports 300, one lower extremity support 400, and a plurality of posts 450 (such as three or four). Different kit embodiments can optionally also contain one or two arm supports 500.

Various materials were referenced above for individual components of the surgical positioner. However, the various supports 100, 300, 400 and posts 450 discussed herein can be made of a variety of different materials, for example having one or more layers of rigid or semi-rigid foam material, viscoelastic memory foam, ethylene-vinyl acetate (EVA) copolymer foam or elastomeric polymer, high-density polyethylene (HDPE), acrylonitrile butadiene styrene (ABS), other thermoplastic polymers, other plastics, metal, various elastomers, etc. They can also have various colored and/or clear coatings thereon. Furthermore, the supports 100, 300, 400 and posts 450 can either fixedly engage one another, such as through polyurethane or other adhesives, hook and loop fasteners, hooks, etc. or can engage one another only by being positioned in physical contact with one another. The individual layers discussed above for each support 100, 300, 400 and post 450 can also be fixedly attached to one another or can be removable/reattachable depending on a desired use. A number of different dimensions and sizes can also be used for the supports 100, 300, 400 and posts 450 in different embodiments. A sterile cover can be placed over the positioner and/or individual supports 100, 300, 400 in use. The cover can be designed as a disposable single-use cover or a reusable cover.

In use as illustrated in FIGS. 1 and 2, the body support 100 and the lower extremity support 400 of the surgical positioner can be secured, such as through table straps and/or the Velcro straps 174, to a surface of an operating environment, such as the operating room table 5000. A position of the support(s) 100, 400 on the operating room table can be varied depending on desired use, such as being positioned on a right or left side of the table depending on which leg is surgically relevant. One or more sterile covers can be placed over the positioner. At this point, a patient 700 can be initially arranged on the body support 100 such that the patient 700 is on his or her back and is received in the torso indentation 116. The patient's right arm 702 is positioned in the arm channel 112 and can be secured to an arm platform 600 protruding away from the table 5000. The patient's left arm 704 is positioned in the arm channel 114 and can be bent at the elbow to rest across the patient. As such, the channel 114 can secure and protect the left, ipsilateral arm 704 while preventing the arm 704 from interfering with the surgeon's operational space during use. The patient's right, non-surgically-relevant leg 710 and left, surgically-relevant leg 712 can each be positioned on corresponding hip supports 300 and the leg support 400. Posts 450 can be used to arrange the legs 710, 712 to provide easier access to a relevant surgical site 750 on the left leg 712 of the patient 700.

During initial patient placement, both hip supports 300 can be in place in the support 100 to provide additional stability. During the operation, however, at least the surgical side hip support 300 can be removed to allow for better access to the surgical site 750, for example to provide better access to the acetabulum in the surgically-relevant leg 712 during an anterior hip replacement surgery. As the operation proceeds, the patient 700 can be shifted as needed. For example, the non-surgically-relevant right leg 710 can be abducted. At the same time, the groin post 120 can resist or prevent the patient 700 from sliding out of proper orientation on the support 100 while not affecting the surgeon's access to the surgical site 750 or interfering with the surgeon's operational space. As such, the groin post 120 can provide countertraction if traction is applied to the left leg 712.

The lower extremity support 400 and the leg platform can be lowered to provide increased access to the surgical site 750 of the leg 712, such as access to a femur in the leg 712 during femoral preparation. While the support 400 is lowered, the posts 450 can help maintain abduction of the right leg 710 while allowing the surgically-relevant left leg 712 to adduct and extend as needed, such as for femoral exposure. The supports 300, 400 and the posts 450 can also be rearranged with respect to the body support 100 to allow operation on a contralateral side of the patient 700. In some embodiments, the positioner can thus be used for a unilateral hip replacement such that a relevant surgical site will only be on a right or left leg. The positioner can thus be arranged as needed to access the relevant surgical site on the right or left leg prior to commencing the operation, and the positioner will not be rearranged during that individual operation in some embodiments.

After the operation, the cover(s) can be disposed of while the surgical positioner can be retained and reused. Reusing the positioner can reduce costs of the operation and help provide consistency when positioning later patients for the same or similar operations. However, in other embodiments, one or more of the supports 100, 300, 400 and/or the posts 450 can be disposable, as needed.

Prior to some operations, a surgeon can take measurements and develop a customized surgical plan for each patient. As such, the positioner can be incorporated into the plan and allow for increased accuracy during implementation. Through use of the positioner, users, such as trained Orthopaedic surgeons, can thus experience reduced variability, reduced margins of error, assistance during initial training for operations using the positioner, less probability of dislocations, etc. The patient 700 illustrated in FIGS. 1 and 2 has a body mass index (BMI) within a normal range, such as between 18.5 and 25. However, the same positioner can be used for patients that have a BMI that exceeds the normal range, such as 25 and greater, 25 to 35, etc., or is below the normal range. The same surgical positioner can thus be used across multiple patients with varying physical conditions and physical dimensions to help reduce costs and promote consistent positioning of patients. In some embodiments, the indentations and channels of the positioner 10 can be sized to provide extra space for the patient 700 with the normal BMI while still providing a stable position such that the indentations and channels provide additional support to any additional tissue of the patient 800 with the higher BMI. As such in some embodiments, the positioner 10 can be sized and shaped to position a patient with a higher BMI, such as the patient 800. However, because the positioner 10 utilizes indentations, channels, and flat surfaces to achieve preferred positioning of a patient, the positioner 10 can still be used on a patient with a lower BMI, such as the patient 700. As such, the positioner 10 can be used for a wide variety of patients, both in terms of height and BMI.

Figure 14:
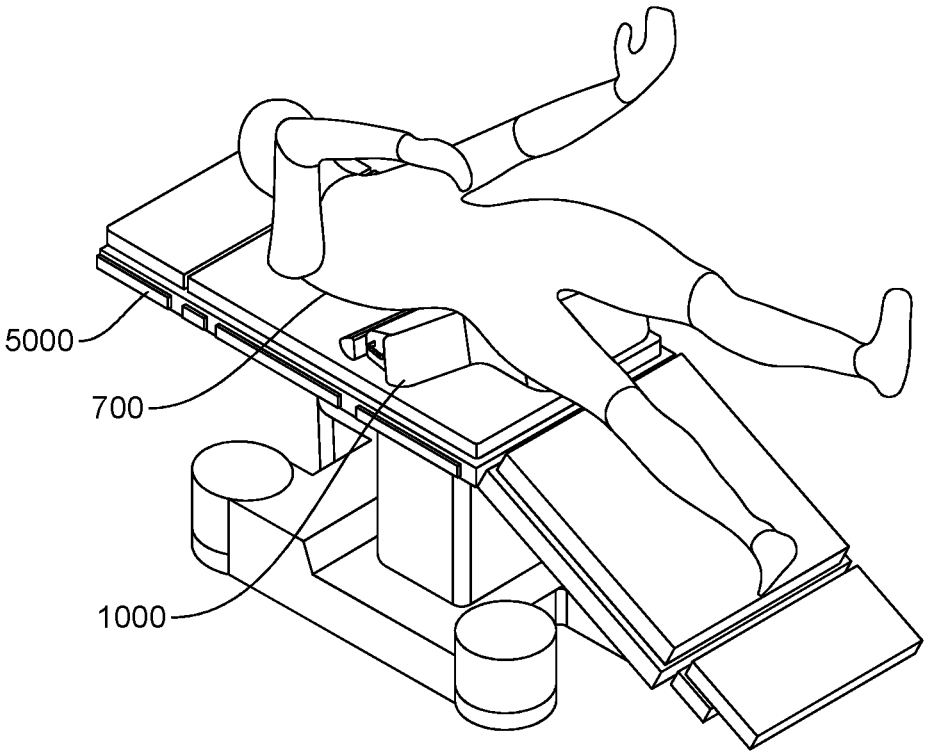
FIG. 14 is a perspective view of a patient arranged on another embodiment of a surgical positioner on top of the operating room table of FIG. 1.
Figure 15:
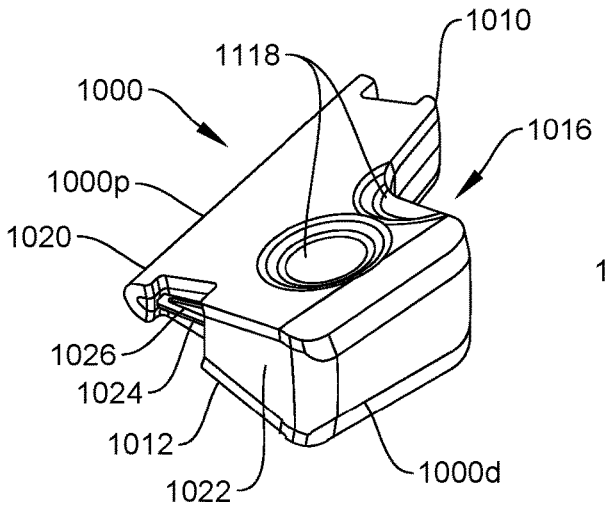
FIG. 15 is a perspective view of a body support of the surgical positioner of FIG. 14.
Figure 16:
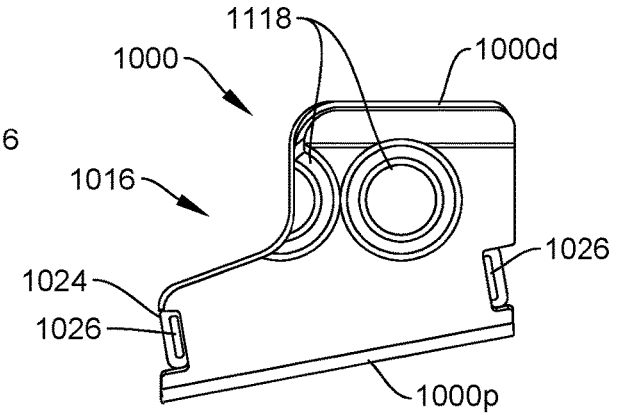
FIG. 16 is a top-down view of the body support of the surgical positioner of FIG. 14.
Figure 17:
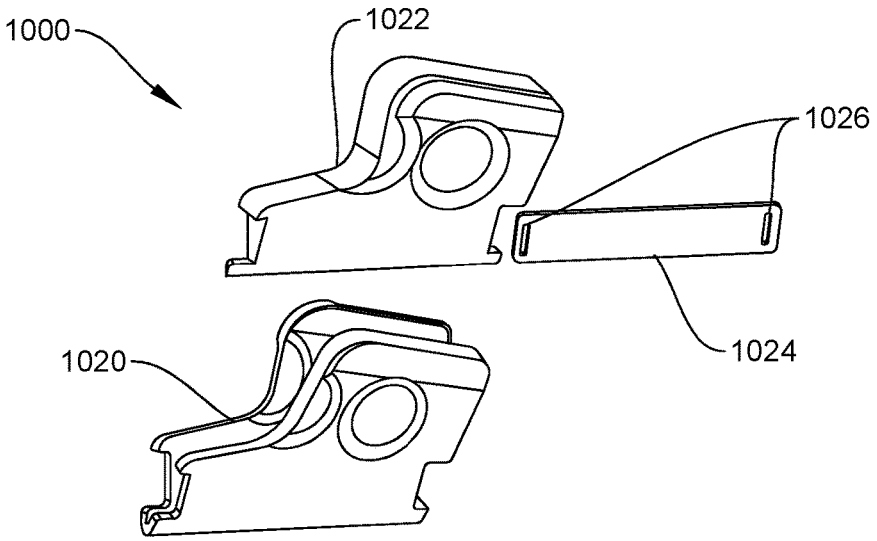
FIG. 17 is an exploded perspective view of the body support of the surgical positioner of FIG. 14.

While the supports 100, 300, 400 of the positioner can provide support to an entire body of a patient, individual supports of the positioner and/or other embodiments of the supports can position specific parts of the patient's body, while other parts of the patient's body can be positioned and supported by various mats, bolsters, cushions, pads, etc. on operating room tables. For example, FIGS. 14-17 illustrate another embodiment of a body support 1000 similar to body support 100. An upper torso of the patient 700 can be supported by various mats and supports on the table 5000, as illustrated in FIG. 14, while a lower torso of the patient is supported by the body support 1000. The support 1000 can thus accommodate for the variability between patient size, height, weight, etc. while still providing proper positioning of a patient's lower back and pelvis. Additionally, the support 1000 can accommodate for more variations in size and shape of operating room tables available at different surgical locations while also being more compact for movement, positioning, storage, etc.

The support 1000 has a proximal end 1000*p*, a distal end 1000*d*, and buttocks indentations 1118 formed on top and bottom surfaces of the support where ischial tuberosities are positioned. The top and bottom surfaces of the support 1000 are mirror images of each other, allowing the support 1000 to be bilateral and flipped over to accommodate both right and left side procedures. The bottom surface of the support 1000 rests on the operating room table, and the support 1000 angles upward from the proximal end 1000*p* to the distal end 1000*d* to provide increased access to the surgical site, for example to provide improved access to the acetabulum.

Additionally, the support 1000 has an operative side 1010 and a non-operative side 1012, and the support is angled higher on the operative side 1010 than the non-operative side 1012 to provide better access to the surgical site, such as improved acetabulum access. There is also a hip recess 1016 on the operative side 1010 to provide improved access to the surgical site. The angulation of the support 1000 can also provide a smooth transition for the patient's body to rest on various mats that can be positioned proximal to the support 1000 on the operating room table without providing additional upper torso or arm support while also providing elevation of a lower body of the patient as the upper torso of the patient sits flush on an operating room table mat. The angulation can thus provide improved posterior access to the operative hip, promote external rotation of the operative leg, and reduce the force required for distraction of the operative leg.

The illustrated support 1000 has three different layers, a cover layer 1020 made of memory foam, a middle layer 1022 of firm foam, and a rigid plastic layer 1024 with table strap slots 1026. These layers are similar to the layers discussed above regarding support 100 and serve similar purposes. However, as with the materials provided above, the materials for the support 1000 can be varied, as desired. Additionally, dimensions of the support 1000 can vary depending on the operation to be performed, the expected patient size and/or population, etc.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it is used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." In addition, use of the term "based on," above and in the claims is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and sub-combinations of the disclosed features and/or combinations and sub-combinations of several further features disclosed above. In addition, the logic flows depicted in the accompanying figures and/or described herein do not necessarily require the particular order shown, or sequential order, to achieve desirable results. Other implementations may be within the scope of the following claims.

What is claimed is:

1. A method of positioning a patient for an anterior hip replacement surgery, comprising:

arranging the patient on a surgical patient positioner such that an upper body of the patient is positioned on a body support of the surgical patient positioner, an operative leg of the patient is positioned on a first hip support and a lower extremity support of the surgical patient positioner, and a non-operative leg of the patient is positioned on a second hip support and the leg support of the surgical patient positioner;

removing the first hip support to access an acetabulum of the operative leg of the patient; and lowering the lower extremity support to access a femur of the operative leg of the patient.

2. The method of claim 1, further comprising abducting the non-operative leg of the patient, wherein the lower extremity support maintains abduction of the non-operative leg while accessing the femur of the operative leg.

3. The method of claim 1, further comprising rearranging the first and second hip supports and the lower extremity support such that the non-operative leg is positioned on the first hip support and the lower extremity support and the operative leg is positioned on the second hip support and the lower extremity support.

4. The method of claim 3, further comprising removing the first hip support to access an acetabulum of the non-operative leg of the patient; and lowering the lower extremity support to access a femur of the non-operative leg of the patient.

* * * * *